United States Patent [19]

Ferguson

[11] Patent Number: 4,480,405

[45] Date of Patent: Nov. 6, 1984

[54] SELF-CLOSING GATE

[76] Inventor: Malcolm J. Ferguson, "Ross-Shire", Dayboro Rd., Samford Valley, Queensland 4502, Australia

[21] Appl. No.: 394,931

[22] PCT Filed: Nov. 12, 1981

[86] PCT No.: PCT/AU81/00161

§ 371 Date: Jun. 28, 1982

§ 102(e) Date: Jun. 28, 1982

[87] PCT Pub. No.: WO82/01734

PCT Pub. Date: May 27, 1982

[30] Foreign Application Priority Data

Nov. 12, 1980 [AU] Australia ..... PE6448

[51] Int. Cl.[3] ..... E06B 11/00

[52] U.S. Cl. ..... 49/131; 49/34; 49/192

[58] Field of Search ..... 49/131, 192, 34

[56] References Cited

U.S. PATENT DOCUMENTS

| | | | |
|---|---|---|---|
| 1,499,120 | 6/1924 | Nies | 49/192 X |
| 2,007,071 | 7/1935 | Burns | 49/131 |
| 2,859,944 | 11/1958 | Cisney | 49/34 X |

FOREIGN PATENT DOCUMENTS

| | | | |
|---|---|---|---|
| 211859 | 5/1956 | Australia | 49/131 |
| 239682 | 5/1960 | Australia | 49/131 |
| 283023 | 5/1966 | Australia | 49/131 |

*Primary Examiner*—Kenneth Downey

*Attorney, Agent, or Firm*—Schwartz, Jeffery, Schwaab, Mack, Blumenthal & Koch

[57] ABSTRACT

A self-closing gate (10) is pivotally mounted between a pair of spaced gate posts (11, 12) to selectively close the gateway therebetween. The gate (10) has end stiles (20, 22) provided with stub axles (21, 24) journalled in bushes (16) fitted in gate support members (14) fixed to the gate posts (11, 12) and counterweights (43) are adjustably mounted on the stiles (20, 22) to return the gate (10) to its normally closed position. Tensioned flexible wires, cables and/or chains (28–33) are strung between the stiles (20, 22) and they support a vehicle buffer (37) which has a bulbous central portion (39) which is engaged by a vehicle (41) to open the gate (10).

To enable the gate (10) to also be swung open about a substantially vertical axis, one of the stiles (22) may include an outer stile (23) fixed on the stub axle (24) and an inner stile (26) releasably connectable to the stub axle (24) (via a socket (25)) and to the outer stile (23) (via a pivotal cap 27).

A catch assembly (50), operated by the wires, cables or chains (28–33) may be provided to releasably lock the gate (10) in the closed position, the catch assembly (50) being releasable when the vehicle engages the gate (10).

7 Claims, 6 Drawing Figures

SELF-CLOSING GATE

BACKGROUND OF THE INVENTION

1. Field of the Invention

This invention relates to a self-closing gate which may be used, inter alia, as a stock gate on farms, pastoral properties or the like.

2. Brief Description of the Prior Art

There have been many proposals for self-closing stock gates and a number of these have reached the manufacturing stage. Most of the gates presently availatle have a number of significant practical disadvantages. The closing mechanisms employed are often complex and rely on systems of springs and linkages to return the gate to the upright closed position. Such systems are expensive to manufacture and assemble and have been proved to be unreliable in field use, being subject to severe service conditions due to a combination of rain, dust, heat and a lack of regular maintenance. It must be appreciated that farmers are notoriously bad at maintaining equipment and will often operate equipment to failure before carrying out any maintenance or servicing.

With most gates, the area adjacent the bottom rail of the gate must be built up so that minimal weight is applied to the bottom rail as a vehicle passes over the rail to prevent the rail from becoming bent, and thereby causing the gate to jam in an open position.

BRIEF SUMMARY OF THE PRESENT INVENTION

It is an object of the present invention to provide a self-closing gate which avoids such systems of springs and linkages or the like to return the gate to the upright closed position.

It is a preferred object to provide such a gate with at least one counter weight assembly to close the gate.

It is a further preferred object to provide such a gate which can also be swung open about a vertical axis to enable the unimpeded passage of livestock through the gateway normally closed by the gate.

It is a still further preferred object to provide such a gate which is fitted with a vehicle buffer assembly, which will effectively operate the gate, without damage to the vehicle (as the vehicle opens the gate), and which will also assist in closing the gate when the vehicle has passed over the gate.

It is a still further preferred object to provide a gate which does not require a rigid bottom rail interconnecting the gate stiles.

Other preferred objects of the present invention will become apparent from the following description.

In one aspect, the present invention resides in a self-closing gate of the type adapted to selectively close a gateway between a pair of spaced gate posts, said gate being characterized by:

a pair of normally upright stiles each having a laterally extending axle means;

a pair of gate support means adapted to be fixed to said gate posts, each axle means being rotatably journalled in a respective one of said support means;

tensioned flexible closure means interconnecting said stiles; and at least one counterweight means connected to at least one of said stiles below said axle means to return said gate to a normally upright closed position when said gate is moved from said upright closed position.

Preferably each gate support means includes a tubular body secured to its respective gate post by a suitable fixing bracket. Preferably a bush (e.g. of nylon) is fitted in the tubular body. Preferably each axle means includes a stub axle directed outwardly from its respective stile and journalled in a respective bush. Removable pins or plates may be provided on the stub axles to locate them in the bushes.

Preferably the flexible closure means includes wires, cables and/or chains strung between the stiles and tensioned by springs connected to the stiles. (Hereafter, the term "wires" shall include cables and/or chains.)

At least one of the wires may interconnect the stiles to brace and triangulate the gate when it is swung to an opened position about a vertical axis.

Vertical wires, interconnected by a number of cross wires, may be provided on each side of the centre of the gate to form tracks for vehicle tires on the gate.

Preferably the counterweight means include concrete blocks which may be filled with metal-punchings or scrap to increase their density. Preferably the blocks are fixed to the stiles by adjustable brackets to enable their height (and restoring moment) to be adjusted.

Preferably a vehicle buffer is mounted at the centre of the gate and is supported by the wires, cables or chains. The buffer may be constructed from a length of rubber conveyor belting or other suitable flexible material and may be provided with a bulbous central portion (when viewed from the side) to be engaged by the vehicle. Preferably the buffer is deformed when the vehicle pushes the gate to the fully open position, the resilience of the buffer assisting the counterweights in returning the gate to the upright closed position when the vehicle has passed over the gate.

A catch means may be provided on one of the stiles to engage a suitable striker on the adjacent gate post to lock the gate in the upright closed position. One of the wires may be connected to the catch to release it when the vehicle first engages the gate to open it.

To enable the gate to be swung open about a vertical axis, one of the stiles may be replaced by a double stile assembly in which an outer stile is fixed to the stub axle, and an inner stile, to which the wires are connected, is releasably received, at its lower end, in a socket on the stub axle, while the upper end is releasably connected to the fixed outer stile by a releasable catch means.

In certain applications, rigid top and/or bottom rails may be fitted to the gate. When a bottom rail is fitted, the soil adjacent to the bottom rail is preferably raised to the level of that rail to reduce the load directly carried by the rail as a vehicle passes over it.

BRIEF DESCRIPTION OF THE SEVERAL VIEWS OF THE DRAWING

To enable the invention to be fully understood, a preferred embodiment will now be described with reference to the accompanying drawing, in which.

DETAILED DESCRIPTION OF THE PREFERRED EMBODIMENT OF THE INVENTION

The gate 10 selectively closes a gateway defined between a pair of spaced gateposts 11 and 12. Fencing wires 13 are connected to the gateposts to form an enclosure about a section of property.

Figure 6:
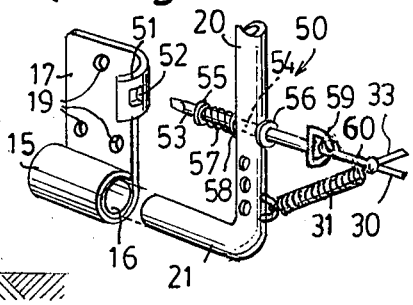
FIG. 6 is an exploded view of the latch which releasably locks the gate in the upright closed position.

A gate support bracket 14 is fitted to each gatepost and each support bracket has a tubular body 15 fitted with a nylon bush 16 (see FIG. 6). A fixing bracket 17 extends upwardly from the tubular body and is fixed to the gatepost by fasteners 18 passing through holes 19 in the bracket 17.

At the end of the gate adjacent gatepost 11, the gate has a stile 20 with an outwardly directed stub axle 21 journalled in the bush 16. Pins (not shown) locate the stub axle in the bush.

A double stile assembly 22 is provided at the other end of the gate. An outer stile 23 is fixed to a stub axle 24 which is journalled in the bush 16 of the support bracket 14 on the gatepost 12 and the stub axle extends inwardly from the outer stile and has a vertical socket 25 which releasably receives the lower end of the inner stile 26. A cap 27 is pivotally mounted at the upper end of the outer stile 23 and is releasably engageable with the upper end of the inner stile 26 to latch the two together (see FIGS. 1 and 2).

The stile 20 and inner stile 26 are interconnected by three horizontal wires 28, 29, 30 which are tensioned by springs 31 connected to the stiles. A pair of inclined wires 32, 33 connect the upper and lower corners of the stiles to brace and triangulate the gate. Vehicle tracks 34, which comprise a pair of vertical wires 35 interconnected by spaced horizontal wires 36, are provided on each side of the centre of the gate for the purpose to be described later in the specification.

A vehicle buffer 37 is mounted centrally on the gate and is supported by the top and bottom wires 28, 30. The buffer 37 is constructed from a length of conveyor belting and is formed into a loop. A pair of rectangular clips 38 are provided around the loop to form a bulbous central portion 39 to be engaged by the bumper 40 of a vehicle 41 (see FIGS. 3 and 4).

A respective counterweight assembly 42 is connected to the stile 20 and the stile assembly 22. Each counterweight assembly has a concrete block 43 which has a curved underside 44 and parallel sides 45. The concrete block is filled with metal scrap and punchings to increase its density substantially threefold to enable a block of smaller volume to be used. The concrete blocks are fastened to the stile 20 and outer stile 23 by a pair of brackets 46 which have their feet 47 fastened to the blocks other legs 48 adjustably bolted to the stiles, spaced holes being provided on the stiles 20, 23 to enable the concrete blocks 43 to be connected thereto to provide the desired restoring moment when the gate is moved from its normally upright closed position.

Suitable trenches 49 are dug under the stiles 20, 23 to provide clearance for the concrete blocks 43.

A catch assembly 50 (see FIG. 6) is provided to releasably secure the gate in the normally upright closed position. A curved striker plate 51 is provided on the fixing 17 on the gatepost 11 and the striker plate has a slot 52. A catch pin 53 is slidably mounted in a hole 54 in the stile 20 and the nose of the pin 53 is releasably engageable in the slot 52.

A pair of rings 55, 56 are fixed to the pin on opposite sides of the stile and a compression spring 57 is interposed between the ring 55 and a sliding ring 58 which engages the stile 20 to urge the pin 53 into engagement with the striker plate. A D-ring 59 is fitted to the inner end of the pin 53 and is connected to the junction of the wires 30 and 33 and the spring 31 by a short connecting wire 60.

Figure 1:
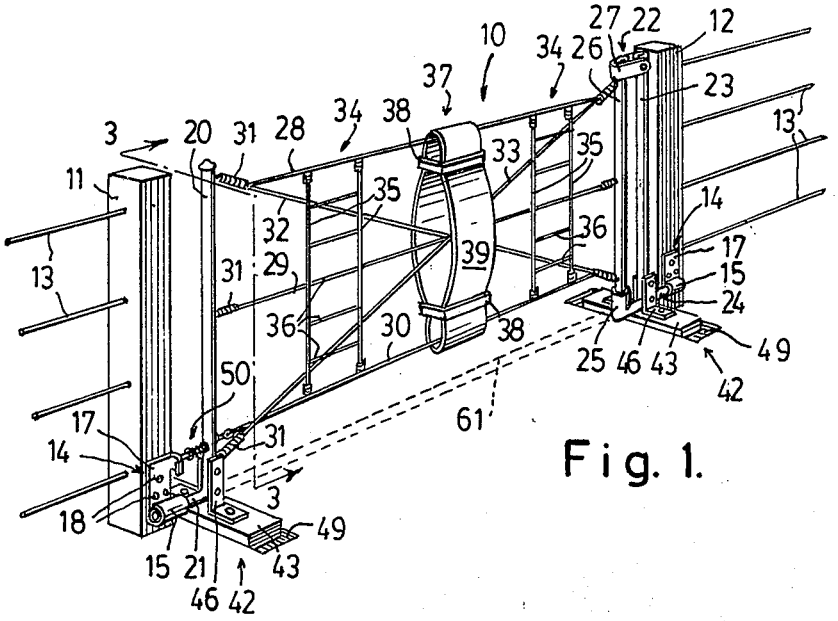
FIG. 1 is a perspective view of the gate in the upright closed position.
Figure 2:
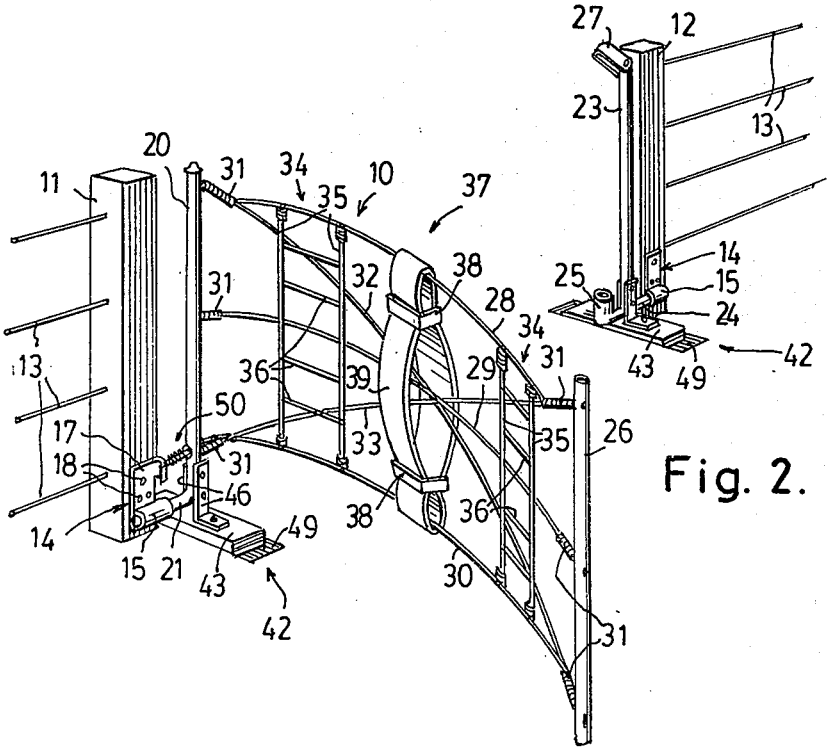
FIG. 2 a similar view showing the gate swung open about a substantially vertical axis.

In certain applications, the stile 20 and stile assembly 22 may be connected by rigid top and/or bottom rails, a bottom rail 61 being indicated by dashed lines in FIG. 1.

The operation of the gate will now be described.

Figure 3:
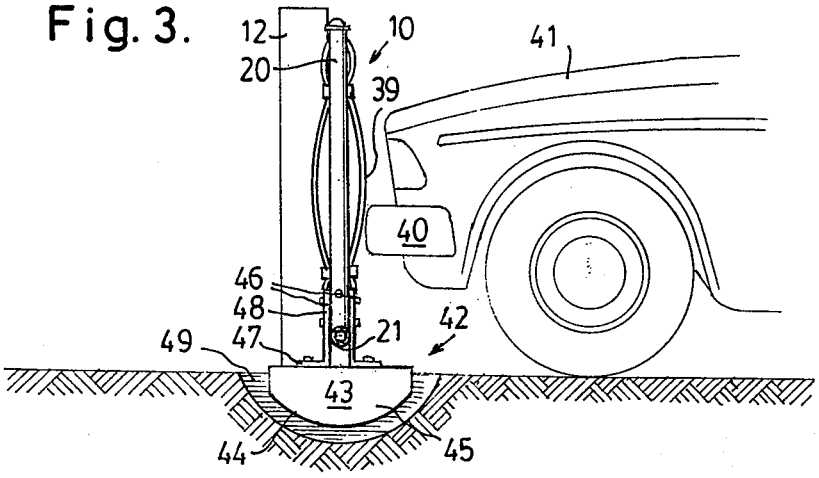
FIGS. 3, 4 and 5 are progressive side views (taken on line 3—3 on FIG. 1) showing the gate being opened by a vehicle.
Figure 4:
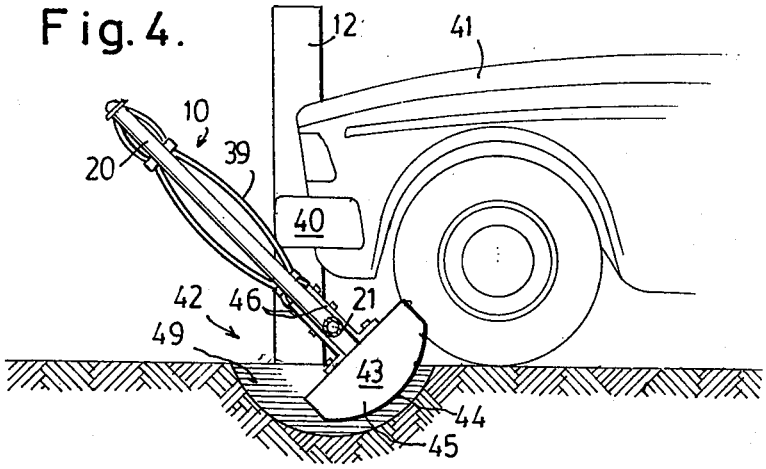

As shown in FIGS. 1, 3, the gate 10 is normally upright to close the gate way and the pin 53 is engaged in the slot 52 in the striker plate.

Figure 5:
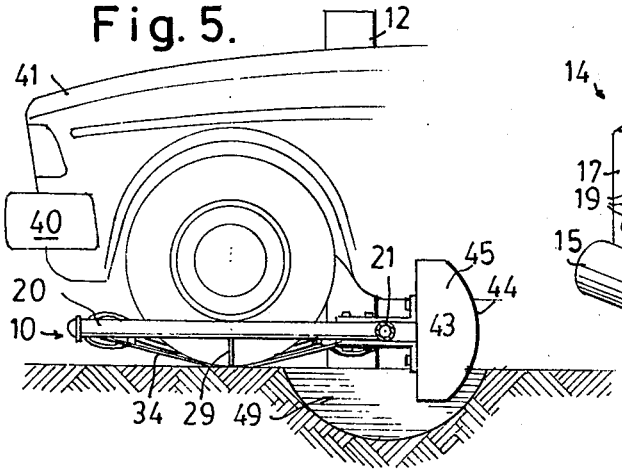

The vehicle 41 approaches the gate 10 and the bumper 40 engages the bulbous central portion 39 of the buffer 37. The buffer 37 pulls on the bottom wire 30 causing the pin 53 to be pulled inwardly against the compression spring 58 to release the pin from the slot 52. As the vehicle 41 continues forward, the gate 10 is pushed over (see FIGS. 4 and 5) until the stiles (20, 22) are substantially horizontal. The vehicle wheels 62 run over the vehicle tracks 34 and hold the gate in the opened position. When the vehicle has passed over the gate, the counterweight assemblies return the gate to the normally upright position. They are assisted by the central position of the buffer 37 as it is deformed on the lower side (see (FIG. 5) and the resilience of the buffer 37 urges the gate upwardly as it returns to its original shape.

To allow the passage of livestock through the gateway, the cap 27 may be raised to release the upper end of the inner stile 26. The stile 26 is lifted free of the socket 25 and the gate 10 may be swung open about the stile 20 (see FIG. 2).

The stiles 20, 22 may be connected by rigid top and/or bottom rails 61, shown in dashed lines in FIG. 1. The gate 10 can still be swung open in the manner just described where the rails are fixed to the inner stile 26 and are connected to the stile 20 by pivotal joints which allow free horizontal, but limited vertical, movement between the rails and the stile 20. Where a bottom rail 61 is provided, the soil adjacent the base of the gate must be raised to the level of the bottom rail to minimise the load applied to the rail as the vehicle 41 passes over the gate.

While a single vehicle buffer 37 is shown, two or more may be provided at spaced intervals across the gate and they may be moulded from suitable plastics material.

In a modified form, the buffer 37 may be of a length so as to be free standing (i.e. supported by the ground) and the top clamp 38 may be provided just below the top wire 28 to support the wire and eliminate any sagging in the wire.

A rod (not shown) may be provided internally of the buffer 37 to interconnect the central and bottom wires 29, 30. This rod will be engaged by the bumper 40 of the vehicle 41 and will pull on the bottom wire 30 to assist in releasing the pin 53 from the slot 52 to enable the gate to be opened.

Various changes and modifications may be made to the embodiment described and illustrated without departing from the scope of the present invention as defined in the claims appended hereto.

I claim:

1. A self closing gate (10) of the type adapted to selectively close a gateway between a pair of spaced gate posts (11,12), said gate being characterized by:

a pair of normally upright stiles (20,22) each having a laterally extending axle means (21,24);

a pair of gate support members (14) adapted to be fixed to said gate posts (11, 12), each axle means (21, 24) being rotatably journalled in a respective one of said support members (14);

tensioned flexible closure means (28–33) non-rigidly interconnecting said stiles to permit said gate (10) to be opened by swinging the same about a vertical axis through one of said stiles (20, 22) while such one stile has its axle means (21,24) journalled in an adjacent said support member (14); and at least one counterweight means (42) connected to at least one of said stiles (20, 22) below said axle means (21, 24) to return said gate (10) to a normally upright closed position when said gate (10) is moved from said upright closed position.

2. A gate as claimed in claim 1 and further characterized in that:

each said gate support member (14) includes a tubular body (15) secured to a respective gatepost (11, 12) by a fixing bracket 17;

a bush (16) being fitted in each said tubular body (15); and each said axle means (21, 24) includes a stub axle (21, 24) directed outwardly from its respective stile (20, 22) and rotatably journalled in a respective one of such bushes (16), removable pins or plates locating said stub axle (21, 24) in its respective bush (16).

3. A gate as claimed in claim 1 or claim 2 and further characterized in that:

said flexible closure means (28–33) include wires, cables and/or chains strung between the stiles (20, 22);

springs (31) connected to the stiles (20, 22) being provided to tension said flexible closure means (28–33).

4. A gate as claimed in claim 1 or claim 2 and further characterized in that:

said counterweight means (42) includes at least one concrete block (43) fixed to said stiles (20, 22) by adjustable brackets (46) to enable adjustment of the restoring moment of said counterweight means (42);

said concrete blocks (43) being filled with metal pieces to increase their density.

5. A gate as claimed in claim 1 or claim 2 and further characterized by:

a vehicle buffer (37) of resiliently flexible material mounted on said flexible closure means (28, 30) intermediate of said stiles (20, 22) and having a bulbous central portion (39) adapted to be engaged by a vehicle (41), the resilience of said buffer (37) assisting the said counterweight means (42) to return said gate (10) to said upright closed position when a vehicle has passed over the gate.

6. A gate as claimed in claim 1 or claim 2 and further characterized by:

a catch means (53) on one of said stiles (20) and connected to said flexible closure means (30, 33);

a striker (51) on the adjacent gatepost (11);

said catch means (53) being operable to engage the striker (51) when said gate (10) is in said upright closed position and releasable from said striker (51) by said flexible closure means (30, 33) when a vehicle (41) engages said gate (10) to open said gate (10).

7. A gate as claimed in claim 1 and further characterized in that:

a socket (25) is fixed on one of said axle means (24);

a releasable stile (26) is releasably engageable in said socket (25) and releasably connectable to the respective one of said stiles (23);

said flexible closure means (28–33) being connected to said releasable stile (26);

said releasable stile (26) being so arranged to enable said gate (10) to be swung open about a substantially vertical axis.

* * * * *